United States Patent [19]

Deaton

[11] Patent Number: 4,664,195

[45] Date of Patent: May 12, 1987

[54] SAFETY VALVE

[75] Inventor: Thomas M. Deaton, Dallas, Tex.

[73] Assignee: Otis Engineering Corporation, Dallas, Tex.

[21] Appl. No.: 824,779

[22] Filed: Jan. 31, 1986

[51] Int. Cl.[4] ..... E21B 34/08; E21B 34/10

[52] U.S. Cl. ..... 166/323; 137/494; 166/324

[58] Field of Search ..... 166/319, 321, 322, 323, 166/324, 237; 137/494

[56] References Cited

U.S. PATENT DOCUMENTS

| | | | |
|---|---|---|---|
| 3,794,112 | 2/1974 | Hill | 166/321 |
| 3,814,181 | 6/1974 | Young | 137/494 |
| 4,062,406 | 12/1977 | Akkeman et al. | 166/323 |
| 4,140,153 | 2/1979 | Deaton | 166/324 |
| 4,339,001 | 7/1982 | Paschel, Jr. | 166/322 |
| 4,362,214 | 12/1982 | Pringle et al. | 166/322 |
| 4,550,780 | 11/1985 | Mott | 166/323 |
| 4,566,478 | 1/1986 | Deaton | 166/323 |

*Primary Examiner*—James A. Leppink
*Assistant Examiner*—Hoang C. Dang
*Attorney, Agent, or Firm*—Thomas R. Felger

[57] ABSTRACT

A direct acting subsurface safety valve. During normal well flowing conditions, an operator sleeve is spring biased to hold the valve closure mechanism in its open position. If the rate of change of fluid pressure flowing through the valve exceeds a preselected value, a pressure sensitive piston will shift the operator sleeve to close the valve. A latch mechanism is provided to prevent undesired closure of the safety valve by acceptable pressure transients resulting from normal changes in well operating conditions.

13 Claims, 7 Drawing Figures

SAFETY VALVE

BACKGROUND OF THE INVENTION

1. Field of the Invention

The present invention discloses a pressure differential operated or direct acting safety valve.

2. Description of Related Art

Gas storage wells are frequently located in depleted hydrocarbon reservoirs at a relatively shallow depth less than five thousand feet. Common characteristics of gas storage wells are relatively low flowing pressures, less than three thousand psi, a large unrestricted flow area and high flow rates with frequent variations in the flow. Examples of subsurface safety valves particularly adapted for use in gas storage wells are shown in U.S. Pat. Nos. 3,481,362; 3,459,260; and 3,491,831. Each of these patents was invented by William W. Dollison and assigned to Otis Engineering Corporation. U.S. Pat. Nos. 3,481,362; 3,459,260; and 3,491,831 are incorporated by reference for all purposes within this application.

Direct acting subsurface safety valves, which are closed by an increase in the fluid flow rate through the valve, are shown in U.S. Pat. No. 3,070,119 invented by George M. Raulins and U.S. Pat. No. 3,126,908 invented by George C. Dickens. Both of these patents disclose using a ball type detent mechanism to hold the respective valve closure means open until the flow rate through the respective valve exceeds a preselected value. U.S. Pat. Nos. 3,070,119 and 3,126,908 are incorporated by reference for all purposes within this application.

A direct acting subsurface safety valve, which is closed by a preselected rate of pressure differential change, is shown in U.S. Pat. No. 4,339,001 invented by James H. Paschal, Jr. This patent discloses a ball type detent mechanism to hold the valve open until the rate of change of fluid pressure within the valve exceeds the preselected value. U.S. Pat. No. 4,339,001 is incorporated by reference for all purposes within this application.

Various types of direct acting subsurface safety valves are commercially available under the trademark STORM CHOKE®, registration number 695,910, assigned to Otis Engineering Corporation.

SUMMARY OF THE INVENTION

The present invention discloses a safety valve for installation within a well flow conductor comprising a housing means with a longitudinal flow passageway extending therethrough, a valve closure means having a first position allowing fluid flow through the longitudinal flow passageway and a second position blocking fluid flow through the longitudinal flow passageway, means for latching the valve closure means in its first position, an operator sleeve slidably disposed within the housing means and partially defining the longitudinal flow passageway, an actuator piston means slidably attached to the operator sleeve and partially defining a variable volume fluid chamber between the exterior of the operator sleeve and the interior of the housing means, means for equalizing fluid pressure between the chamber and fluid pressure within the longitudinal flow passageway, the actuator piston means having means for releasing the latching means, and means for shifting the valve closure means from its first position to its second position after the latching means has been released.

One object of the present invention is to provide a new and improved pressure differential rate operated safety valve which is releasably held open (first position) by a latching means until the rate of pressure change exceeds a predetermined value. The pressure difference is sensed between the pressure within a variable volume chamber within the valve and the pressure of fluids flowing through the valve.

Another object is to provide a pressure differential rate operated safety valve having a gas chamber with means for equalizing pressure in the gas chamber with fluid pressure interior to the safety valve.

A further object of the present invention is to provide a safety valve which closes (second position) upon the occurrence of a change in pressure differential of predetermined rate and will open when the pressure differential is equalized.

A still further object is to provide a latching means and releasing means for a safety valve which will accommodate minor differential pressure fluctuations and/or slow changes in the pressure of fluids flowing through the valve without shifting the valve closure means to its second position.

Additional objects and advantages of the present invention will be readily apparent to those skilled in the art from reading the following written description in conjunction with the drawings and claims.

DESCRIPTION OF THE PREFERRED EMBODIMENT

Figure 1:
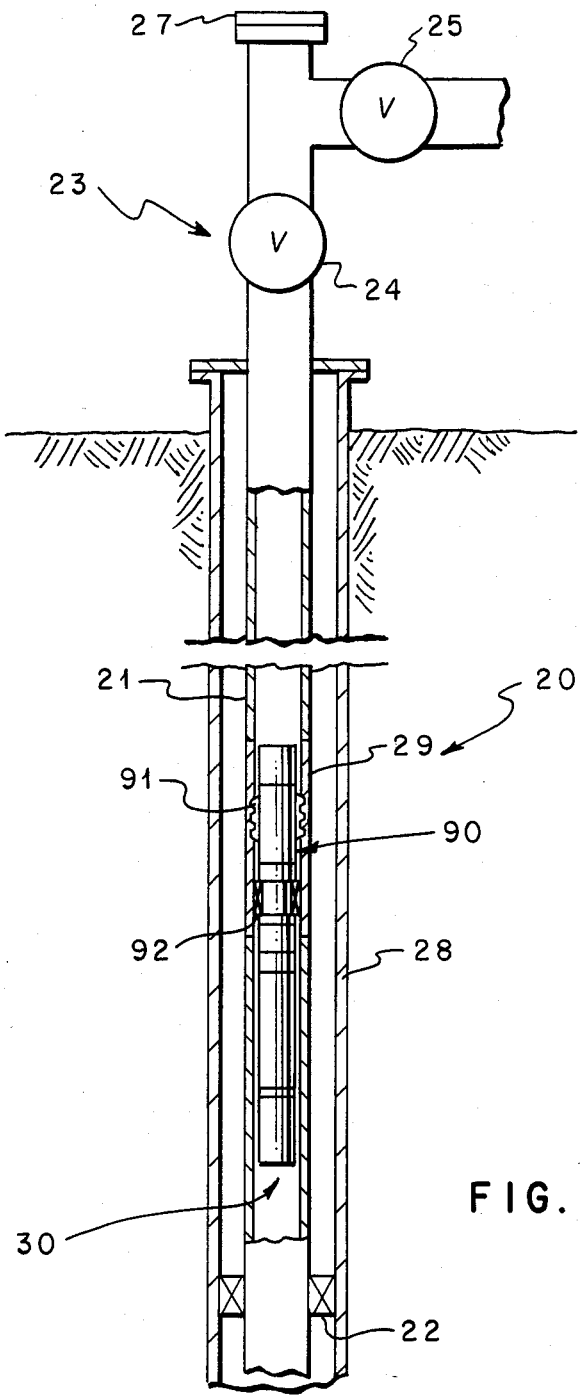
FIG. 1 is a schematic view partially in section showing a subsurfaace safety valve system embodying the present invention.

Referring to FIG. 1, well completion 20 includes casing string 28 extending from the well surface to a hydrocarbon producing formation (not shown). Tubing string 21 is concentrically disposed within casing 28 and extends from wellhead 23 through production packer 22 which seals between tubing string 21 and casing 28. Packer 22 directs formation fluids such as oil, gas, water, and the like into tubing string 21 from perforations (not shown) in casing 28 which admit formation fluids into the well bore. Flow control valves 24 and 25 at the well surface control fluid flow from tubing string 21. Wellhead cap 27 is provided on wellhead 23 to permit servicing well 20 via tubing string 21 by wireline techniques which include the installation and removal of various downhole flow control devices such as safety valve 30. Other well servicing operations which may be carried out through tubing string 21 are bottom hole temperature and pressure surveys.

Subsurface safety valve 30 embodying the features of the invention is installed in tubing string 21 to control fluid flow to the well surface via tubing string 21 from a downhole location. Landing nipple 29 is included as a part of tubing string 21 to provide the downhole location for installing safety valve 30. Lock mandrel 90 has keys 91 to releasably engage a matching profile in the interior of landing nipple 29. Lock mandrel 90 also has seal means 92 on its exterior to form a fluid barrier with the portion of landing nipple 29 adjacent thereto. Seal means 92 directs fluid flow within tubing string 21 through lock mandrel 90 and safety valve 30 attached thereto. U.S. Pat. No. 3,208,531 to Jack W. Tamplen discloses a landing nipple and lock mandrel satisfactory for use with the present invention.

Figure 2B:
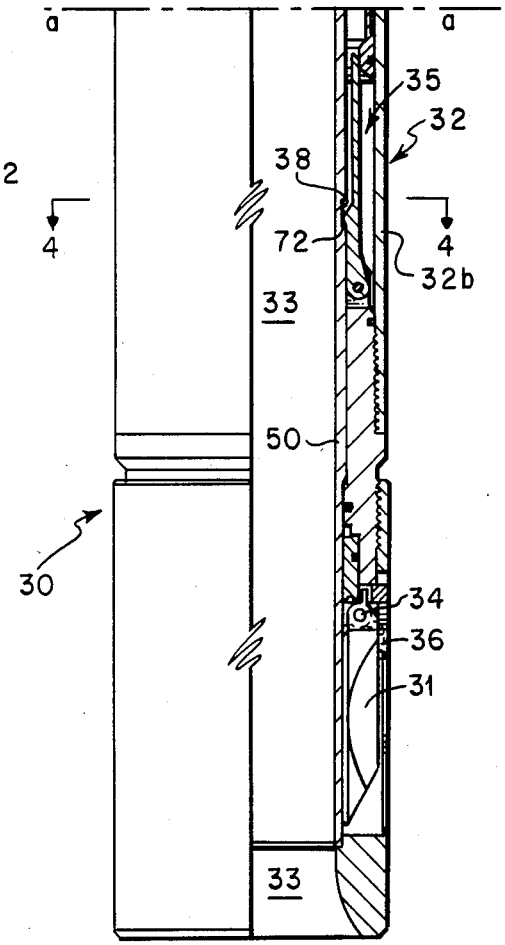
Figure 3A:
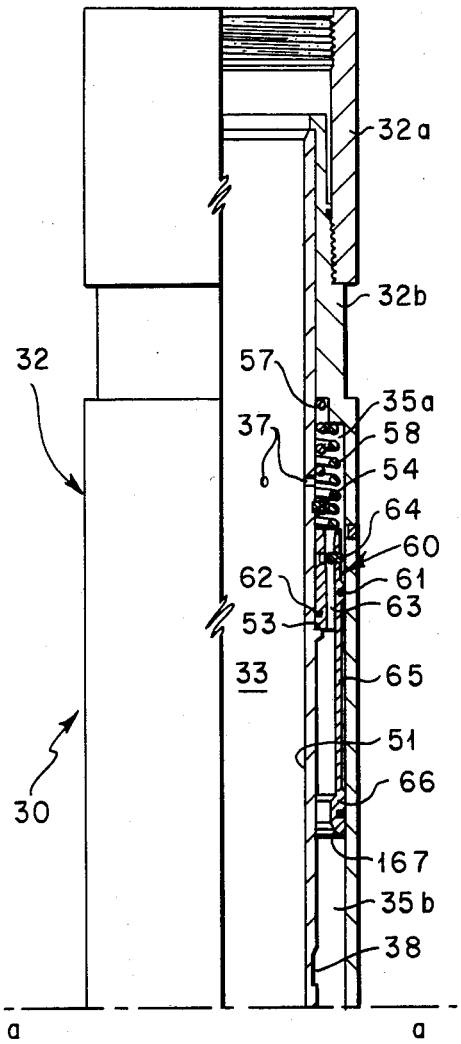
FIGS. 3A and 3B are drawings, partially in section and partially in elevation, showing the safety valve in its second, closed position.
Figure 3B:
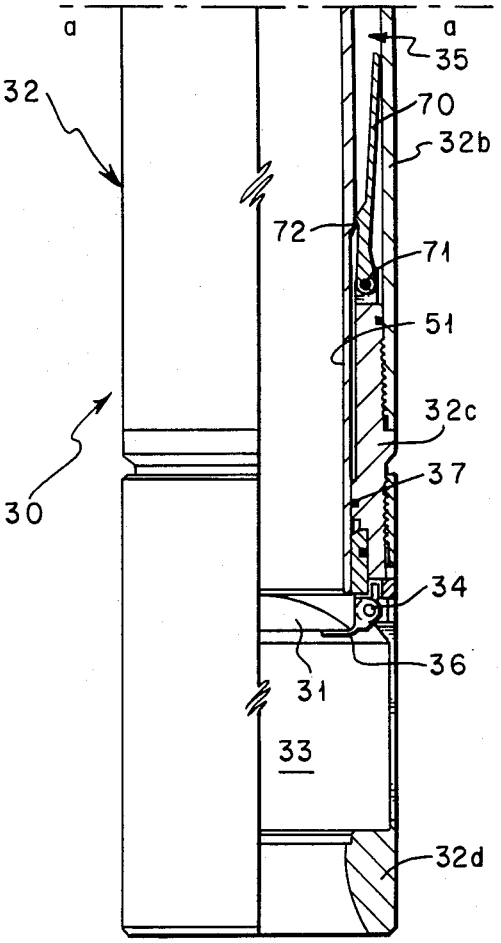
Figure 4:
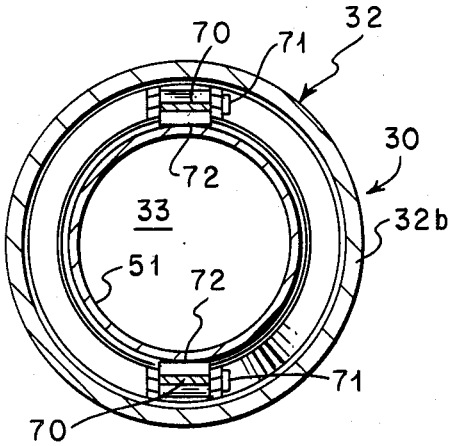
FIG. 4 is an enlarged view in section along line 4—4 of FIG. 2B showing the latching means.

Safety valve 30 includes flapper type valve closure means 31 mounted by hinge 34 for swinging between its first, open position (FIG. 2B) and its second, closed position (FIG. 3B). Coiled spring 36 around hinge 34 provides means for shifting flapper 31 from its first to its second position. Operator sleeve 50 is used to shift valve closure means 31 from its second to its first position. As shown in U.S. Pat. No. 3,273,588 to W. W. Dollison, operator sleeve 50 could be used to open and close either a ball or poppet type valve closure means in addition to the flapper type. U.S. Pat. No. 3,273,588 is incorporated by reference for all purposes within this application.

The exterior of safety valve 30 is defined by housing means 32 with longitudinal flow passageway 33 extending therethrough. For ease of manufacture and assembly, housing means 32 has four subassemblies 32*a, b, c,* and *d*. Each housing means subassembly is generally cylindrical with a longitudinal bore extending therethrough. Each subassembly is threadedly engaged to adjoining subassemblies with appropriate o-ring seals to prevent undesired fluid communication between the interior and exterior of housing means 32. The longitudinal bores of each housing subassembly are concentrically aligned to partially define longitudinal flow passageway 33.

In FIG. 3A, housing subassembly 32*a* functions as a connector to any suitable lock assembly such as lock mandrel 90 for anchoring safety valve 30 within a well flow conductor. Preferably, the lock assembly will form a seal with the well flow conductor above safety valve 30 so that the flow of well fluids through the well flow conductor can take place only through safety valve 30.

Operator sleeve 50 is slidably disposed within housing means 32 and forms an annulus 35 between the exterior of sleeve 50 and the interior of housing means 32. Longitudinal bore 51 extends through sleeve 50 and partially defines a portion of longitudinal flow passageway 33 through valve 30. Piston means 60 is slidably attached to the exterior of operator sleeve 50 between first stop shoulder 53 and second stop shoulder 54. For ease of manufacture and assembly, first stop shoulder 53 is machined on the exterior of operator sleeve 50 and projects therefrom. Second stop shoulder 54 is a snap ring which can be installed in groove 55 on the exterior of operator sleeve 50 after piston means 60 is positioned thereon. Second stop shoulder 54 is spaced longitudinally from first stop shoulder 53 to allow longitudinal movement of piston means 60 therebetween.

Figure 5:
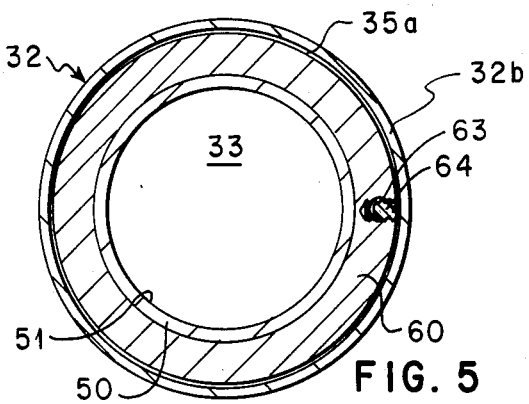
FIG. 5 is an enlarged view in section along line 5—5 of FIG. 2A showing the piston means.

Piston means 60 is a generally hollow cylinder sized to surround operator tube 50 and to fit within annulus 35. See FIG. 5. Seal means 61 and 62 are carried on the exterior and interior, respectively, of piston means 60 to divide annulus 35 into first fluid pressure zone 35*a* and second fluid pressure zone 35*b*. At least one passageway 63 is drilled through piston means 60 to provide a first port means to communicate fluid pressure between first zone 35*a* and second zone 35*b*. Regulating screw 64 extends partially through piston means 60 into passageway 63 intermediate the ends thereof. Adjusting the extension of screw 64 into passageway or first port means 63 allows regulation of the fluid flow rate therethrough. This is an important feature for controlling the sensitivity of safety valve 30 to changes in fluid pressure within longitudinal flow passageway 33.

Second port means 37 extend radially through operator sleeve 50 to communicate fluid pressure between longitudinal flow passageway 33 and first pressure zone 35*a*. O-ring seal 37 is carried on the interior of housing subsection 32*c* to form a fluid barrier with the exterior of operator sleeve 50. O-ring seal 37 and seal means 61 and 62 cooperate to prevent fluid communication with second zone 35*b* except via first port means 63. First and second pressure zones 35*a* and 35*b* are variable volume chamber means partially defined by piston means 60 in annulus 35. First port means 63 and second port means 37 provide means for equalizing fluid pressure between the variable volume chamber means 35*a* and *b* and longitudinal flow passageway 33.

At least one and preferably two latch fingers 70 are disposed in annulus 35. One end of each latch finger 70 is attached by pivot pin 71 to housing subassembly 32*c*. Pivot pin 71 allows limited rotational movement of attached latch finger 70 between the exterior of operator sleeve 50 and the interior of housing means 32. Shoulder 72 projects from finger 70 towards operator sleeve 50. Annular groove 38 is provided on the exterior of operator sleeve 50 and is sized for engagement with shoulder 72. Annular groove 38 and shoulder 72 are located such that operator sleeve 50 will hold valve closure means 31 in its first position when shoulder 72 is secured within annular groove 38. Thus finger 70, pivot pin 71, shoulder 72, and annular groove 38 comprise a portion of the means for latching valve closure means 31 in its first position. Directing latching operator sleeve 50 to housing means 32 prevents high fluid flow rates through longitudinal flow passageway 33 from shifting valve closure means 31 to its second position. Therefore, safety valve 30 can be satisfactorily used in gas storage wells having very high flow rates.

Piston means 60 has skirt 65 extending longitudinally therefrom toward latch fingers 70. Enlarged flange 66 is provided near the lower end of skirt 65 to engage fingers 70. Flange 66 has an inwardly tapered surface 167 which is formed to contact the extreme end of latch fingers 70 opposite from pivot pins 71. The thickness of flange 66 is selected to allow it to slide downwardly between fingers 70 and the interior of housing means 32. This downward movement of flange 66 and attached piston means 60 causes slight rotation of fingers 70 around pivot pin 71. Flange 66 is designed to hold latch fingers 70 engaged with operator sleeve 50. Shoulder 72 is machined with a slight taper such that upward force on operator tube 50 will cause fingers 70 to pivot away from annular groove 38 when flange 66 is removed from behind fingers 70.

First spring 57 is disposed on the exterior of operator sleeve 50 between first shoulder 54 and shoulder 67 on the interior of housing means 32. First spring 57 provides means for biasing operator sleeve 50 to shift valve closure means 31 to its first position. Second spring 58 is also disposed on the exterior of operator sleeve 50 between piston means 60 and shoulder 68 on the interior of housing means 32. Second spring 58 concentrically surrounds first spring 57. Second spring 58 provides means for biasing piston means 60 to contact first shoulder 53 of operator sleeve 50. Second spring 58, when piston means 60 is resting on first shoulder 53, assists first spring 57 in moving operator sleeve 50 to open valve closure means 31.

OPERATING SEQUENCE

Figure 2A:
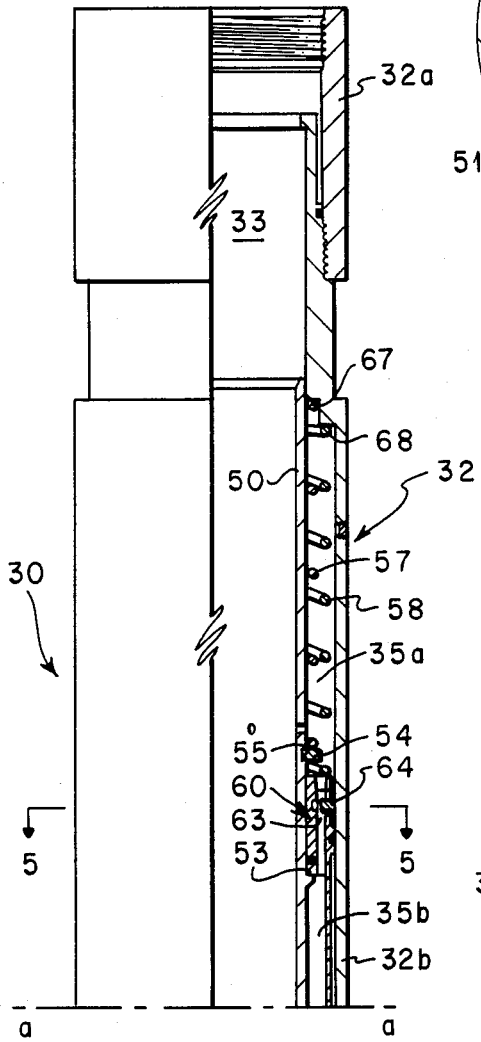
FIGS. 2A and 2B are drawings, partially in section and partially in elevation, showing the safety valve in its first, open position.

The following comments are made assuming that safety valve 30 is installed in a gas producing or storage well completed as shown in FIG. 1. Safety valve 30 is opened by admitting fluid pressure from the well surface via flow control valves 24 and 25 into tubing string 21 to equalize any pressure differential across valve closure means 31. This same fluid pressure is communicated via second port means 37 to first pressure zone 35*a* and first port means 63 to second pressure zone 35*b*. When fluid pressures in zones 35*a* and *b* are equal, biasing means 57 and 58 will both apply force to move operator sleeve 50 longitudinally relative to housing means 32 to open valve closure means 31. Piston means 60 moves in unison with operator sleeve 50 during this time. As tapered surface 167 of flange 66 contacts latch fingers 70, latch fingers 70 will rotate slightly to engage shoulder 72 with annular groove 38 to latch valve closure means 31 in its first position. When valve closure means 31 is fully opened, flange 66 will be positioned between fingers 70 and housing means 32 to hold latch fingers 70 engaged with operator sleeve 50. Safety valve 30 is thus opened as shown in FIGS. 2A and B to allow fluid flow to the well surface via tubing 21.

Some variation in the fluid flow rate through longitudinal flow passageway 33 is expected during normal well conditions. Also, some variations in fluid pressure, especially for gas storage wells, are expected during normal well production. Changes in pressure within longitudinal flow passageway 33 are communicated with first pressure zone 35*a* via second port means 37. By selecting the proper size and number of port means 37, a change in fluid pressure in longitudinal flow passageway 33 can be reflected almost immediately within first pressure zone 35*a*. However, only one passageway (first port means 63) communicates with second pressure zone 35*b*, and this passageway is partially blocked by screw 64. Therefore, second pressure zone 35*b* does not respond as rapidly to pressure changes within longitudinal flow passageway 33, and a pressure differential can be created across piston means 60. Second spring 58 tends to hold piston means 60 in contact with first shoulder 53 even though fluid pressure in second pressure zone 35*b* may be slightly higher than fluid pressure in first pressure zone 35*a*. Therefore, small changes in pressure or a slow rate of pressure change within longitudinal flow passageway 33 will not cause piston means 60 to release latch fingers 70 from operator sleeve 50.

During an emergency condition such as damage to wellhead 23 which allows fluids to rapidly escape from tubing string 21, the resulting rapid increase in fluid flow rate through longitudinal flow passageway 33 would cause a corresponding rapid decrease in fluid pressure. As previously noted, second pressure zone 35*b* is not able to quickly respond to pressure changes due to regulating screw 64 restricting flow through first port means 63. Therefore, a rapid drop in pressure within longitudinal flow passageway 33 results in a net force acting on piston means 60 to move it longitudinally away from latch fingers 70.

The net forces acting on piston means 60 must first overcome second spring 58 and slide piston means 60 upwardly into contact with second shoulder 54. The spacing of second shoulder 54 relative to first shoulder 53 is selected so that piston means 60 will move a sufficient distance to fully withdraw flange 66 from behind fingers 70. Thus, skirt 65 and flange 66 on piston means 60 function as means for releasing the latching means (fingers 70 and annular groove 38) when sufficient differential pressure is applied to piston means 60.

After piston means 60 contacts second shoulder 54 and latch fingers 70 have been released from engagement with operator sleeve 50, the net pressure forces acting on piston means 60 will overcome both springs 57 and 58 to shift operator sleeve 50 longitudinally to release flapper 31 and allow it to shift to its second position. The closing of flapper 31 is assisted by coiled spring 36 and fluid flow through longitudinal flow passageway 33.

By varying the extension of regulating screw 64 into first port means 63, the sensitivity of piston means 60 to pressure changes can be controlled. A relatively large, unrestricted flow path through first port means 63 means that a relatively large, rapid change in pressure is required to create enough differential pressure to move piston means 60 and unlatch operator sleeve 50. A relatively small, restricted flow path through first port means 63 means that a relatively small, slow change in pressure can create enough differential pressure to shift valve closure means 31 to its second position.

ALTERNATIVE EMBODIMENTS

Safety valve 30 may be used in any suitable well flow conductor having an appropriate downhole location to receive safety valve 30 and to direct fluid flow therethrough. Other well completions may have multiple tubing strings or have only casing 28.

The flow of fluid through first port means 63 could be controlled by placing a removable orifice therein instead of using regulating screw 64. In alternative designs of safety valve 30, second spring 58 could be replaced by a small spring abutting second shoulder 54 and piston means 60.

The preceding written description explains only some embodiments of the present invention. Those skilled in the art will readily see other modifications and variations without departing from the scope of the invention which is defined by the claims.

What is claimed is:

1. A direct acting safety valve for installation within a well flow conductor comprising:

a. a housing means with a longitudinal flow passageway extending therethrough;

b. a valve closure means having a first position allowing fluid flow through the longitudinal flow passageway and a second position blocking fluid flow through the longitudinal flow passageway;

c. an operator sleeve slidably disposed within the housing means to shift the valve closure means from its second position to its first position and partially defining the longitudinal flow passageway;

d. piston means slidably attached to the operator sleeve and partially defining variable volume chamber means between the exterior of the operator sleeve and the interior of the housing means;

e. means for equalizing fluid pressure between the variable volume chamber means and fluid pressure flowing through the longitudinal flow passageway;
f. means for latching the valve closure means in its first position;
g. the piston means including means for releasing the latching means;
h. means for shifting the valve closure means from its first position to its second position after the latching means has been released;
i. the latching means having a latch finger disposed between the exterior of the operator sleeve and the interior of the housing means and pivotally attached to the housing means;
j. means for releasably engaging the latch finger with the operator sleeve; and
k. a portion of the piston means holding the latch finger engaged with the operator sleeve.

2. A safety valve as defined in claim 1 wherein the means for releasably engaging the latch finger comprises an annular groove on the operator sleeve and a shoulder on the finger sized to contact the groove.

3. A direct acting safety valve for installation within a well flow conductor comprising:
a. a housing means with a longitudinal flow passageway extending therethrough;
b. a valve closure means having a first position allowing fluid flow through the longitudinal flow passageway and a second position blocking fluid flow through the longitudinal flow passageway;
c. an operator sleeve slidably disposed within the housing means to shift the valve closure means from its second position to its first position and partially defining the longitudinal flow passageway;
d. piston means slidably attached to the operator sleeve and partially defining variable volume chamber means between the exterior of the operator sleeve and the interior of the housing means;
e. means for equalizing fluid pressure between the variable volume chamber means and fluid pressure flowing through the longitudinal flow passageway;
f. means for latching the valve closure means in its first position;
g. the piston means including means for releasing the latching means;
h. means for shifting the valve closure means from its first position to its second position after the latching means has been released;
i. the latching means having a latch finger disposed between the exterior of the operator sleeve and the interior of the housing means and pivotally attached to the housing means;
j. means for releasably engaing the latch finger with the operator sleeve;
k. a portion of the piston means holding the latch finger engaged with the operator sleeve;
l. the piston means slidably disposed between a first stop shoulder and a second stop shoulder on the exterior of the operator sleeve;
m. the piston means dividing the variable volume chamber means into a first pressure zone and a second pressure zone; and
n. first port means extending through the piston means to communicate fluid pressure between the first zone and the second zone.

4. A safety valve as defined in claim 3 further comprising:
a. means for biasing the operator sleeve to shift the valve closure means to its first position; and
b. means for biasing the piston means to contact the first shoulder of the operator sleeve.

5. A safety valve as defined in claim 4 further comprising:
a. an annulus formed between the exterior of the operator sleeve and the interior of the housing means with the piston means slidably disposed therein;
b. a portion of the annulus comprising the variable volume chamber means; and
c. The equalizing means comprising a second port means extending from the chamber means through the operator sleeve and allowing fluid communication with the longitudinal flow passageway.

6. A safety valve as defined in claim 3 further comprising means for controlling fluid flow rate through the first port means.

7. A direct acting safety valve for installation within a well flow conductor comprising:
a. a housing means;
b. a longitudinal flow passageway extending through the housing means;
c. a valve closure means having a first position allowing fluid flow through the longitudinal flow passageway and a second position blocking fluid flow through the longitudinal flow passageway;
d. an operator sleeve slidably disposed within the housing means and partially defining the longitudinal flow passageway;
e. means for biasing the operator sleeve to shift the valve closure means to its first position;
f. an annulus formed between the exterior of the operator sleeve and the interior of the housing means;
g. piston means disposed within the annulus and slidably attached to the operator sleeve;
h. seal means carried by the housing means and engaging the exterior of the operator sleeve spaced longitudinally from the piston means;
i. variable volume chamber means formed within the annulus and partially defined by the seal means;
j. the piston means dividing the chamber means into a first pressure zone and a second pressure zone;
k. means for latching the operator sleeve to hold the valve closure means in its first position;
l. means for equalizing fluid pressure between the chamber means and the longitudinal flow passageway;
m. first port means extending through the piston means to communicate fluid pressure between the first zone and the second zone; and
n. a second port means extending through the operator sleeve to allow fluid communication between the chamber means and the longitudinal flow passageway.

8. A safety valve as defined in claim 7 further comprising means for controlling fluid flow rate through the first port means.

9. A safety valve as defined in claim 7 wherein the latching means further comprises:
a. a latch finger disposed between the exterior of the operator sleeve and the interior of the housing means and pivotally attached to the housing means;
b. means for releasably engaging the latch finger with the operator sleeve; and
c. a portion of the piston means holding the latch finger engaged with the operator sleeve.

10. A safety valve as defined in claim 9 wherein the means for releasably engaging the latch finger comprises an annular groove on the operator sleeve and a shoulder on the finger sized to contact the groove.

11. A safety valve as defined in claim 9 further comprising means for releasing the latch means in response to fluid pressure changes within the longitudinal flow passageway.

12. A safety valve as defined in claim 11 wherein the means for releasing the latching means comprises:

a. the piston means slidably disposed between a first stop shoulder and a second stop shoulder on the exterior of the operator sleeve;

b. the piston means dividing the variable volume chamber means into a first pressure zone and a second pressure zone; and c. first port means extending through the piston means to communicate fluid pressure between the first zone and the second zone.

13. A safety valve as defined in claim 12 further comprising means for biasing the piston means to contact the first shoulder of the operator sleeve.

* * * * *